US010125485B2

(12) United States Patent
Bergeron

(10) Patent No.: US 10,125,485 B2
(45) Date of Patent: Nov. 13, 2018

(54) MODULAR STRUCTURE SYSTEM

(71) Applicant: Russell Bergeron, Spring, TX (US)

(72) Inventor: Russell Bergeron, Spring, TX (US)

( * ) Notice: Subject to any disclaimer, the term of this patent is extended or adjusted under 35 U.S.C. 154(b) by 0 days.

(21) Appl. No.: 15/342,861

(22) Filed: Nov. 3, 2016

(65) Prior Publication Data

US 2018/0119409 A1 May 3, 2018

(51) Int. Cl.
*E04B 1/24* (2006.01)
*E04B 1/19* (2006.01)

(52) U.S. Cl.
CPC ..... *E04B 1/2403* (2013.01); *E04B 1/1903* (2013.01); *E04B 2001/1957* (2013.01); *E04B 2001/2415* (2013.01); *E04B 2001/2451* (2013.01); *E04B 2001/2463* (2013.01)

(58) Field of Classification Search
CPC ..... E04B 1/2403; E04B 1/1903; E04B 2001/2463; E04B 2001/2451; E04B 2001/1957; E04B 2001/2415
See application file for complete search history.

(56) References Cited

U.S. PATENT DOCUMENTS 8,695,310 B2 * 4/2014 Tremblay ..... E04B 1/24 52/483.1
2005/0111912 A1 * 5/2005 Brain ..... A47B 57/50 403/353

* cited by examiner

*Primary Examiner* — Patrick J Maestri
(74) *Attorney, Agent, or Firm* — Law Office of Jeff Williams; J. Oliver Williams

(57) ABSTRACT

A system and method for a modular structure system is illustrated. The system includes a plurality of posts and beams. The posts are vertically oriented to define a space. The plurality of posts includes a mating aperture. A beam is included to span the distance between the posts. The beam includes a mating stud protruding out from the beam and configured to pass through the mating apertures of the plurality of posts. An anchor is in communication with the plurality of posts to secure each into a desired position. Siding is coupled to the plurality of posts and the beams to restrict access between the plurality of posts. The location of the beams is interchangeable between the plurality of posts so as to adjust the layout of the space without moving the posts.

16 Claims, 10 Drawing Sheets

MODULAR STRUCTURE SYSTEM

BACKGROUND

1. Field of the Invention

The present application relates to a building structure, and more particularly to a building constructed of modular members and adjustable after construction to customize space to desired changing needs.

2. Description of Related Art

Buildings are constructed today for many different reasons. Each building is made to suit a general need, whether it be for residential, commercial, or for personal needs. Once built, building are not easily adjusted. If needs arise requiring the modification to an existing structure, great costs can be incurred. Buildings are constructed with concrete, steel, and other materials. These are securely fastened together. Use of these materials in large scale can be a disadvantage. Large amounts of concrete are costly and are extremely heavy. Steel can also be hard and bulky to transport. Modification or remodeling of a structure built in conventional ways with large amounts of concrete and steel are near impossible.

A system is needed to allow for the quick and safe building of a structure that permits for the easy modification and adjustment of its own structure. Although strides have been made to improve the buildings constructed today, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
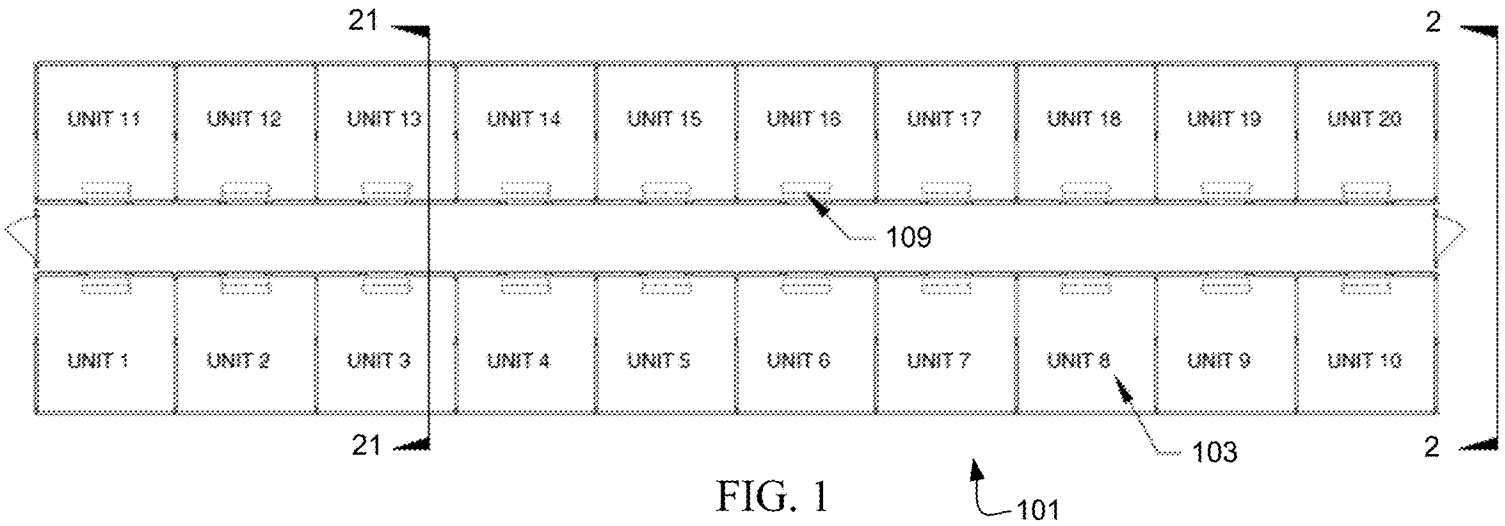
FIG. 1 is a plan view of a modular structure system according to an embodiment of the present application.

While the device and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the systems are depicted in the attached drawings. However, as will be recognized by those skilled in the art after a complete reading of the present application, the systems, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the system described herein may be oriented in any desired direction.

The system and method in accordance with the present application overcomes one or more of the above-discussed problems commonly associated with traditional building structures. In particular, the system of the present application is a fully modular system configured to permit for the selective assembly and disassembly of portions of its structures to allow a user to adapt it for present needs. The structure is composed of modular beams and posts configured to nestle together in a plurality of methods. An advantage of this system is the drastic reduction in weight from the materials conventionally used. This allows for cost reductions and greater simplicity to build. These and other unique features of the system are discussed below and illustrated in the accompanying drawings.

The system and method will be understood, both as to its structure and operation, from the accompanying drawings, taken in conjunction with the accompanying description.

Several embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The system and method of the present application is illustrated in the associated drawings. The system includes a plurality of vertically oriented posts that are used to define a space. One or more beams are placed between the posts to divide the space as needed. The posts and beams are releasably coupled using a mating stud and a mating aperture respectively. Additional fasteners may also be used to assist in securing them together. An anchor system is used in communication with the posts to secure them to the foundation. Any number of siding members are then used to line the perimeter of the structure (i.e. walls and/or ceiling) to secure the contents within the space. Other miscellaneous elements may be included to customize the function and versatility of the modular structure system. Additional features and functions of the system are illustrated and discussed below.

Referring now to the drawings wherein like reference characters identify corresponding or similar elements in form and function throughout the several views. FIGS. 1-22 illustrate assorted views and elements of a modular structural system 101 of the present application. In FIG. 1, a top level plan view of system 101 is illustrated. System 101 is configured to include a plurality of different types of members that permit a fully customizable configuration to a builder. Additionally, the system remains fully adjustable after being initially secured by the type of coupling that occurs. Fasteners are used in combination with mating studs and mating apertures. A builder may quickly lay out a plan, cut material, attach any necessary end clips, and begin building. The manner in which the members are coupled allow for strong bonds and permit for a reduction of overall building materials used when compared to traditional methods. Costs are reduced as are the overall weight of the structure.

A prime use for system 101 is in the storage industry. Description of the many features and advantages of system 101 will be done with respect to a storage building. However, it is understood that other buildings are well suited, such as sheds, out buildings, commercial buildings, and so forth. Use as a storage structure is not meant to be herein limiting.

In FIG. 1, system 101 has been used to construct a two wide storage unit. Structures build through system 101 may be any shape and size. Additionally, these structures can reach any known height with as many floors as desired. In FIG. 1, a single story design has been selected for description. As seen, multiple individual units are separated out in an orderly manner. Dual entry is provided and a single access corridor is used to reach each unit 103.

Figure 2:
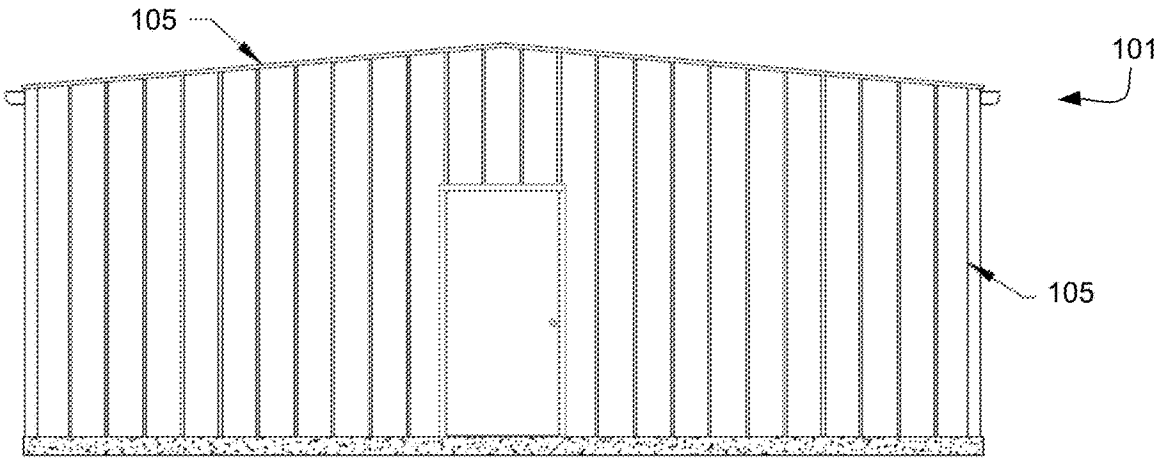
FIG. 2 is side view of the modular structure system of FIG. 1.

Referring now to FIG. 2 in the drawings, a side view of system 101 is illustrated, as seen externally. Siding 105 is illustrated attached to the sides of structure 101. Siding 105 may be used on external and internal sides, as well as the external roofing.

Figure 3:
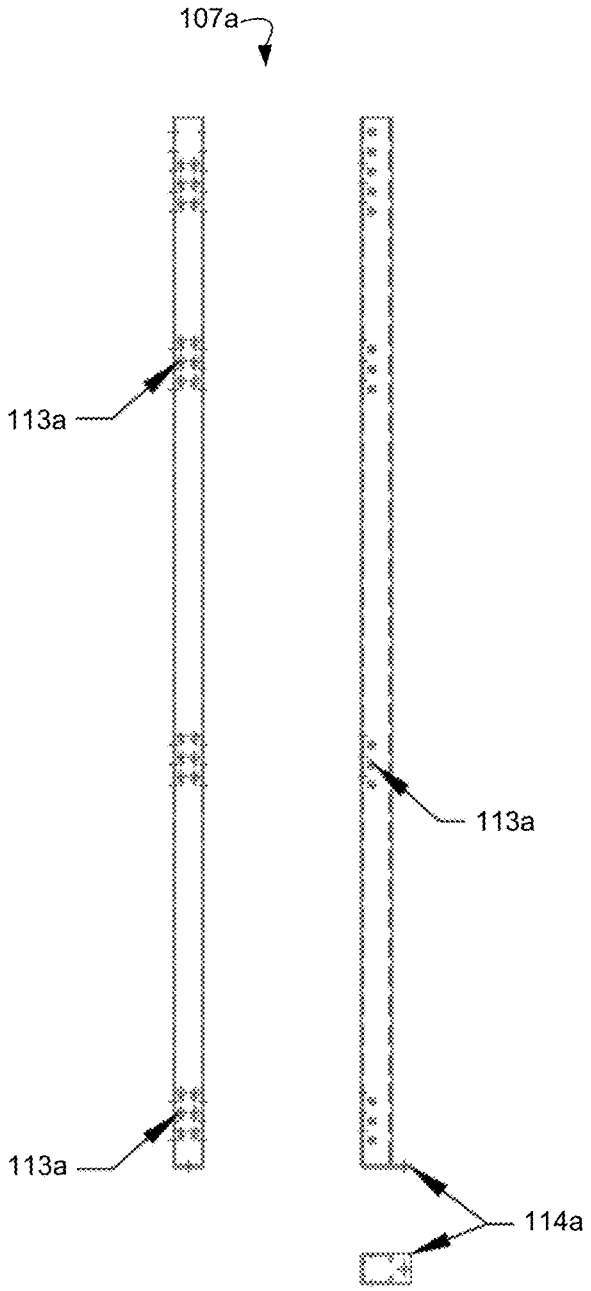
FIGS. 3-5 are assorted views of different posts used to construct the modular structure system of FIG. 1.
Figure 4:
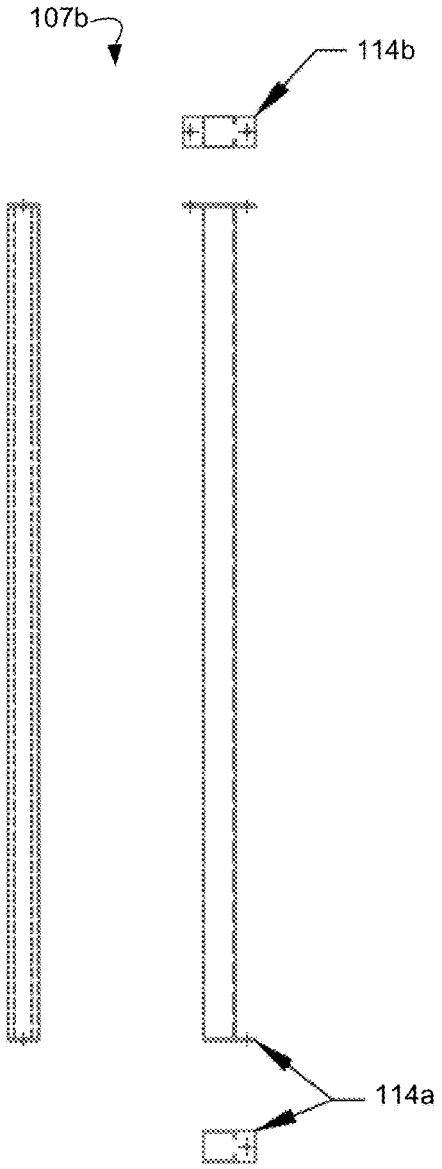
Figure 5:
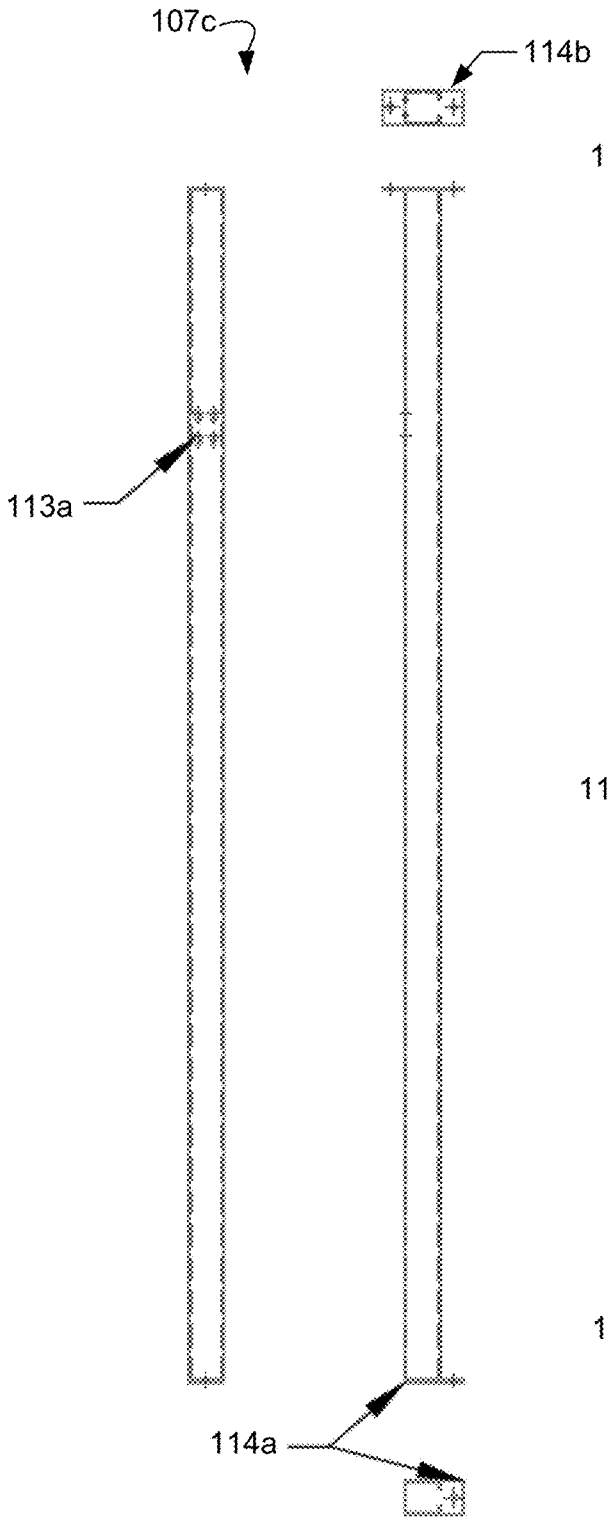

Referring now also to FIGS. 3-5 in the drawings, assorted views of posts used in system 101 are illustrated. Posts 107*a*-107*c* are illustrated in FIGS. 3-5 respectively. Posts 107*a-c* are configured to provide vertical support and stabilization within system 101. They are mounted relatively vertically and secured to the foundation. Each post 107*a-c* is made from a roll formed section having typical metal gauges of 14, 13, 12, and 11. It is understood the size and gauging of posts 107*a-c* are customized to the particular site and loading conditions. Other gauging is contemplated. An exemplary dimension of posts 107*a-c* are 3 inches by 3 inches. In FIG. 3, a single post 107*a* is illustrated. These come in different lengths as a customary and typical post within system 101. Important to note is that the metal framing gauge thickness can go from 10 Ga all the way to a 4" structural column and the R panels (siding & walls, roof. for 18 ga to 28 ga.) The size of the posts rolled formed frames can be 3× or 3×4 structural (inches) or even 3 inch & 4 inch C channel for existing building systems. Other beam/post profiles can be used in this system too.

FIG. 4 illustrates a single post 107*b* for a particular use of constructing a roll up door jamb. Posts 107*b* are configured to permit the easy attachment and securing of a roll up door 109. In system 101, it is generally contemplated that each unit 103 includes at least one roll up door 109. Post 107*b* may include optional tracks for guidance of door 109 as necessary. FIG. 5 illustrates a single post 107*c* for a main door jamb. Uses for post 107*c* can be for conventional doorways and passageways for forming the access corridor among other things.

Figure 11:
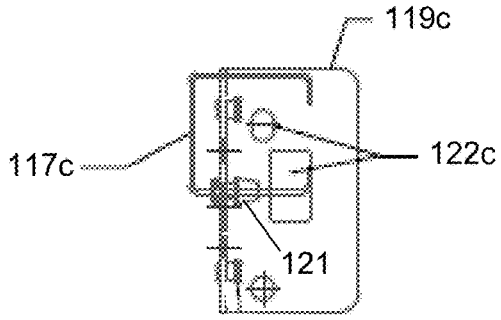
Figure 13:
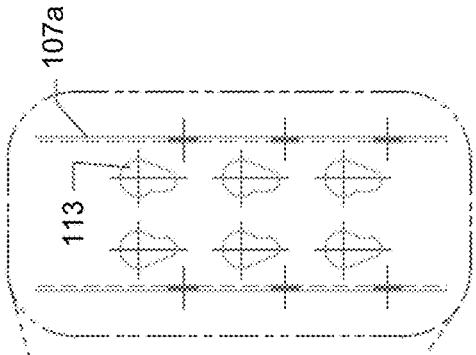
FIG. 13 is a front view of exemplary cutouts for use in the posts of FIGS. 3-5.
Figure 12:
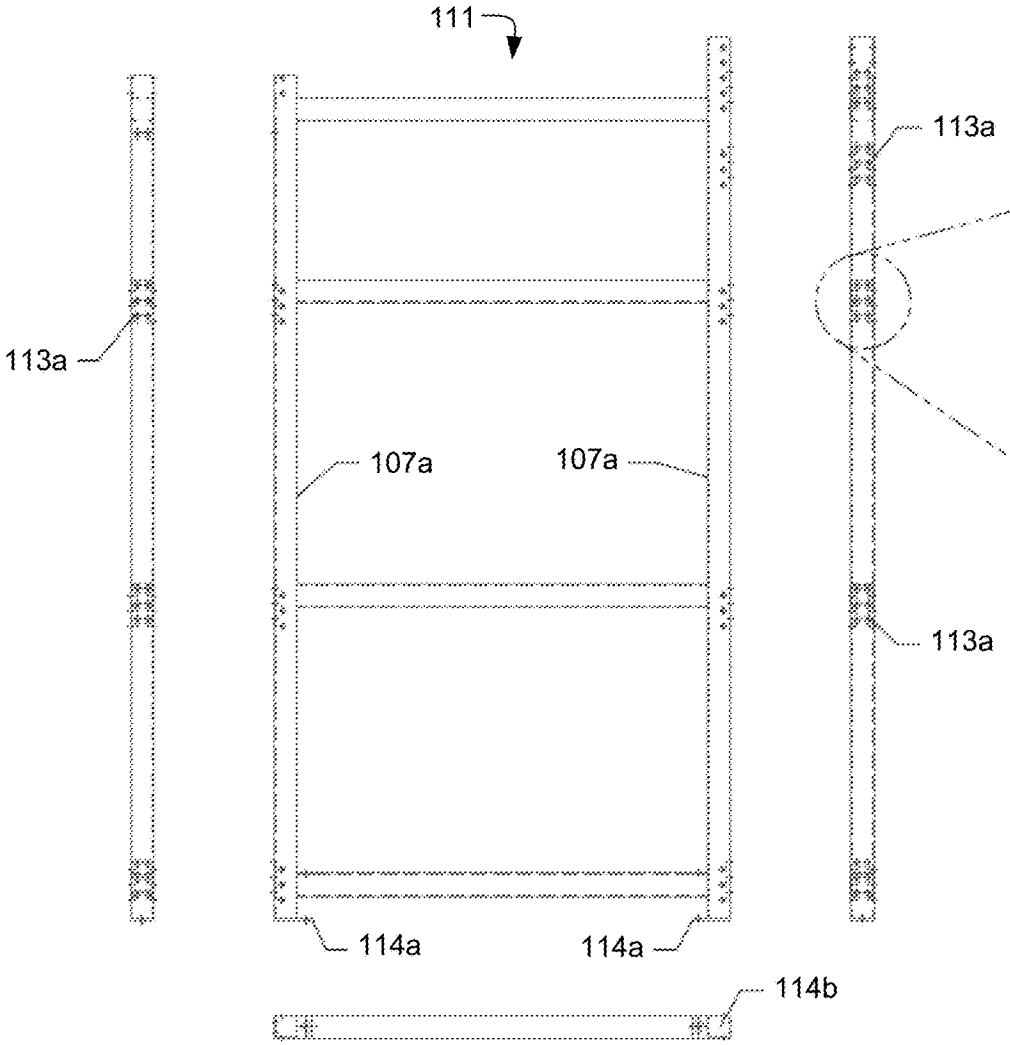
FIG. 12 is a front, side, and top view of a frame used in the modular structure system of FIG. 1.

Referring now also to FIGS. 12 and 13 in the drawings, a frame 111 is illustrated. Frame 111 is a combination of assorted posts 107*a-c* and beams (see FIG. 6-11). These frames can be pre-built and set in their respective locations at the time of build or may be built and set at the same time individually piece by piece. In FIG. 12, a side, front and top view of frame 111 is shown. Of particular note is that frame 111 can be constructed out of any combination of posts 107*a-c*. Frame 111 contains posts 107*a* separated by a number of beams. The length of posts 107*a* are varied. Additionally, by changing the length of the posts, a slope for a roof line may be created.

Each post 107*a-c* includes a mating aperture 113*a* and 113*c* respectively. A mating aperture is specially shaped hole in a side of the tubing making post 107*a* and 107*c*. mating apertures 113*a-c* may be located at any location and on any surface of posts 107*a-c* and frame 111 as needed to make a connection with the beams and spacers (see FIG. 18). They contain a particular pattern and are configured to accept a mating stud from the beams seen in FIGS. 6-11. Mating studs are passed through the mating aperture. Gravitational forces cause the mating studs to rest along a bottom surface of the mating aperture. Gravity is used to secure the two members together. Additional fasteners may be used to provide a secondary and sure positional orientation relative to one another. Mating apertures 113*a* and 113*c* can come at preset locations along the length of the post. These help to define potentially the type and purpose of post 107. It is understood though that mating apertures 113 may be formed in any of posts 107*a* and 113*c* at any height so as to permit customization. It is noted that a mating aperture is not shown with post 107*b*. As noted above, such mating aperture may be formed after receipt by the builder either before, during, or after construction. It should also be understood that posts

107*a-c* may each optionally contain a plate 114*a-b* located at either a top end or bottom end relative to each post's orientation in system 101. Plate 114*a-b* is configured to be used to accept one or more fasteners through one or more holes. These holes may align with mating apertures that may be located in any beam as described below.

Figure 6:
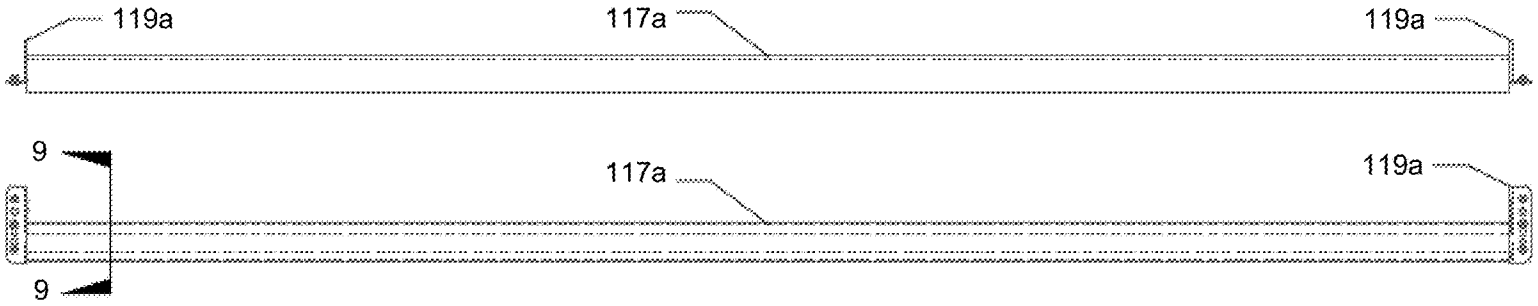
FIGS. 6-8 are assorted views of beams used to construct the modular structure system of FIG. 1.
Figure 7:
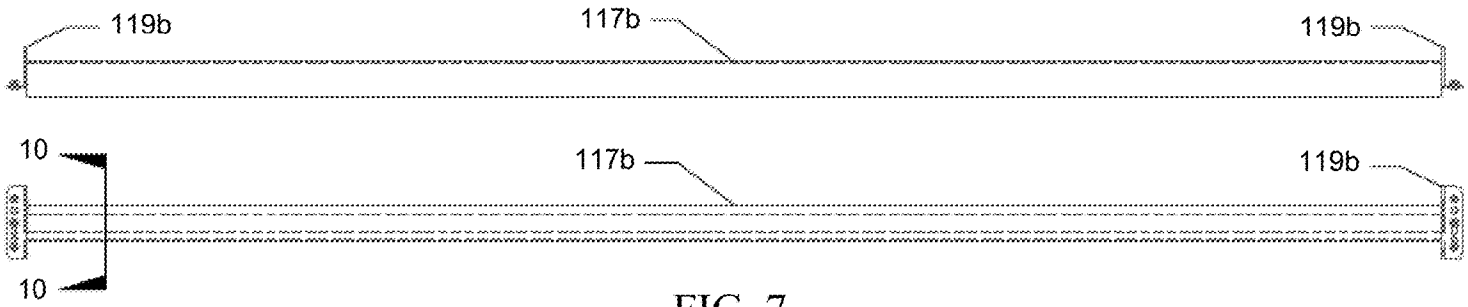
Figure 8:
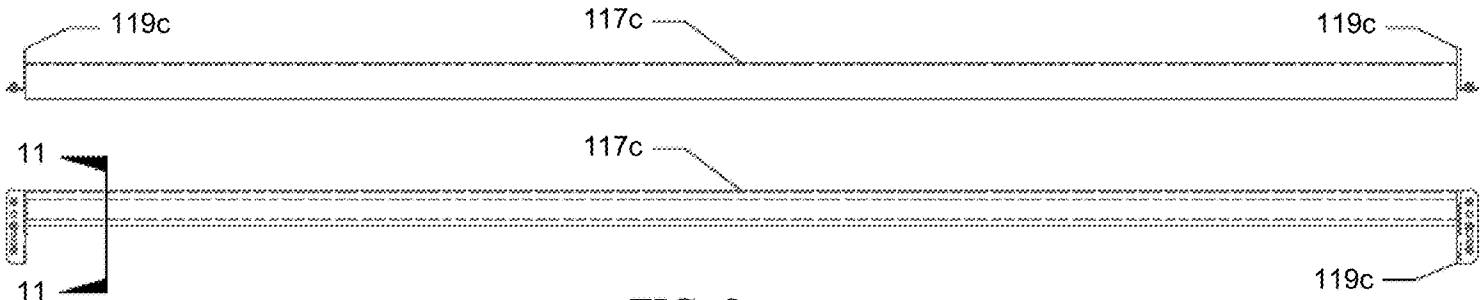

Referring now also to FIGS. 6-8 in the drawings, assorted views of beams used to construct the modular structure system. Beams 117*a-c* are illustrated in both a top view and a front view. Beams 117*a-c* are configured to span a distance between two or more posts 107*a-c* (any combination of posts 107*a-c*). Beams 117*a-c* are a wall girt/roof joist section made in any number of different cross section shapes, such as a roll formed C-Section. The particular cross section shape will depend upon site loading conditions.

Figure 9:
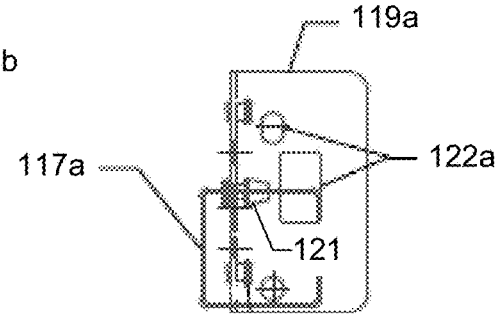
FIGS. 9-11 are enlarged end views of the beams of FIGS. 6-8.
Figure 10:
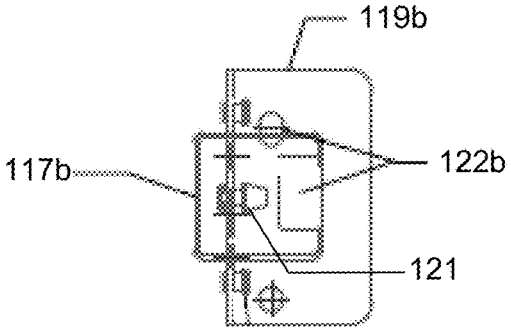

Beams 117*a-c* each include an end clip 119*a-c* located at opposing ends of the beams. End clips 119*a-c* are configured to include mating studs 121 and optionally any number of additional fastening apertures 122*a-c* for acceptance of a fastener as seen more closely in FIGS. 9-11. FIGS. 9-11 are enlarged views of end clips 119*a-c*. End clips 119*a-c* may be formed integrally with its respective beam or may be added at a later time depending on building structure parameters. For example, beams 117*a-c* may be formed without end clips 119*a-c* to allow for desired trimming to occur. Once trimmed, end clips 119*a-c* may be coupled to the ends by any known methods, such as welding or fasteners for example.

A difference between beams 117*a-c* are the off-set location of end clip 119*a-c* relative to beam 117*a-c*. The off-set helps to grant a smooth face across the exterior of the structure for siding 105 installation. Additionally it helps to ensure a smooth face internally as well. In FIG. 6, end clip 119*a* is off-set from beam 117*a* to have large drop in the location of beam 117*a* from the top of end clip 119*a*. In FIG. 7, beam 117*b* is more centrally located within end clip 119*b* and therefore presents a less severe drop compared to that seen in FIG. 9. Lastly, FIG. 11 illustrates where beam 117*c* is located adjacent the top surface of end clip 119*c* wherein a minimal drop is realized. The length of end clips 119*a-c* may be adjusted so as to customize the level of drop realized.

Figure 14:
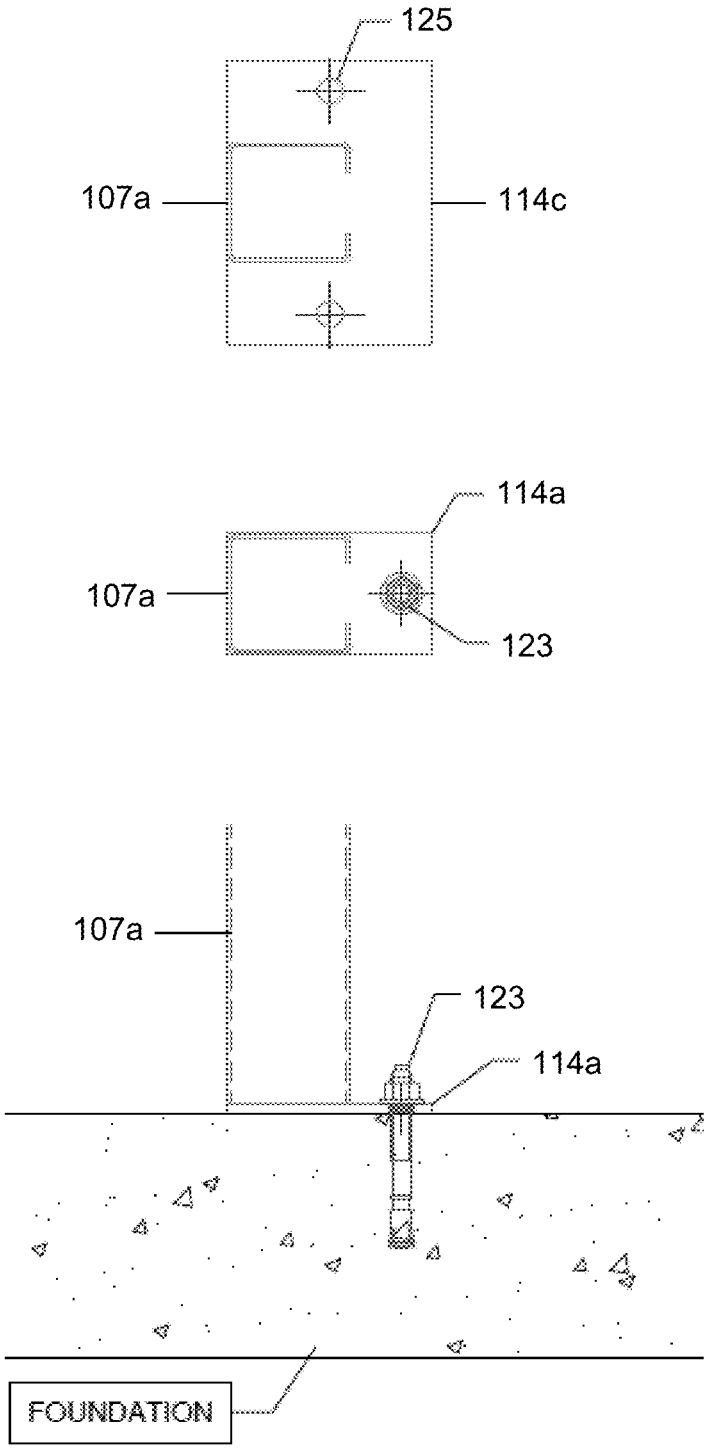
FIG. 14 is a side and top view of an anchor used in the frame of FIG. 3.

Referring now also to FIG. 14 in the drawings, a side and top view of an anchor is illustrated. Anchor 123 is a fastener used to pass through plate 114*a* at the bottom end of post (107*a-c*) to secure it in a desired position on the foundation. A plate aperture 125 is illustrated for passage of anchor 123. A plurality of apertures 125 may be used and be found in any pattern apart from that herein shown.

Figure 15:
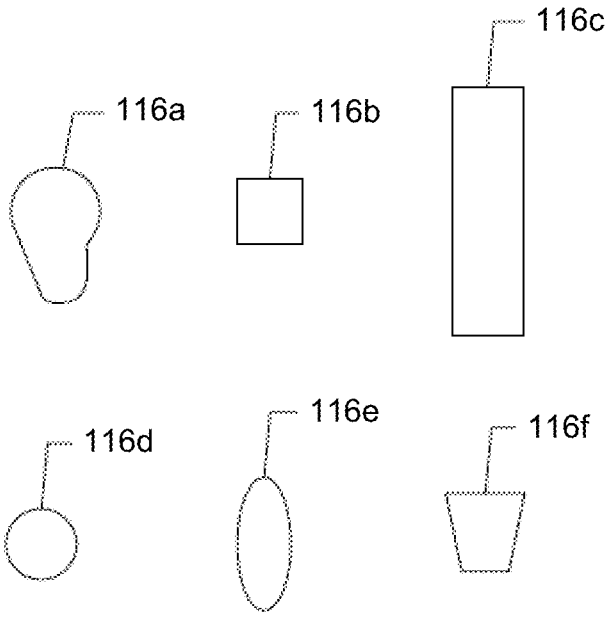
FIG. 15 is a section view of exemplary profiles for the mating apertures on the posts of FIGS. 3-5.

Referring now also to FIG. 15 is a section view of exemplary profiles for the mating apertures on the posts of FIGS. 3-5. Mating apertures 113 may be found in any style or shape. As seen in FIG. 13, each aperture is configured to permit the corresponding mating stud the ability to pass through and be lowered into contact with a lower surface of the mating aperture. As gravity is the predominant force for locating the beams, a predominantly horizontal design would not be as preferable. The exemplary mating aperture shapes 116*a-f* are shown. Mating aperture 116*a* is a tear drop shape. Mating aperture 116*b* is a square hole shape. Mating aperture 116*c* is a rectangle shape. Mating aperture 116*d* is a hole. Mating aperture 116*e* is an egg shaped hole. Mating aperture 116*f* is keystone shaped. These are not meant to be exhaustive in nature but to serve as examples of the various styles and shapes for a mating aperture.

Figure 16:
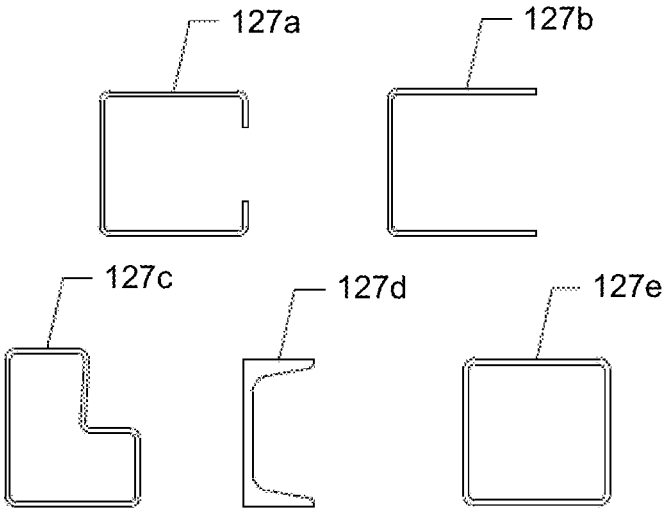
FIG. 16 is set of exemplary cross section views of the beams and posts in the modular structure system of FIG. 1.

FIG. 16 is set of exemplary cross section views of the beams 117*a-c* and posts 107*a-c* in modular structure system 101. As noted previously, the posts 107 were stated to be formed from as a rolled formed shape. Other shapes and cross section contours are possible. The various cross section shapes of FIG. 16 are equally applicable to beams 117*a-c* as they are to posts 107*a-c*. Shape 127*a* is a roll formed C-section. Shape 127*b* is a formed C-section. Shape 127*c* is a roll formed beam section. Shape 127*d* is a structural channel. Shape 127*e* is a tube section. Each has its own applications to which it is best suited.

Figure 17:
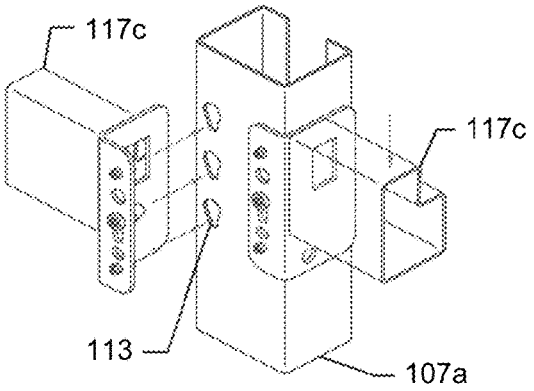
FIG. 17 is a perspective and partially exploded view of the beams attaching to a post in the modular structure system of FIG. 1.

Referring now also to FIG. 17 in the drawings, a perspective and partially exploded view of a post and two beams are illustrated. In this Figure, post 107*a* is illustrated as having mating apertures 113 along its entire length. Beams 117*c* in the shape of contour 127*c* are located adjacent to post 107*a*. The mating studs are passed into and through mating apertures 113.

Figure 18:
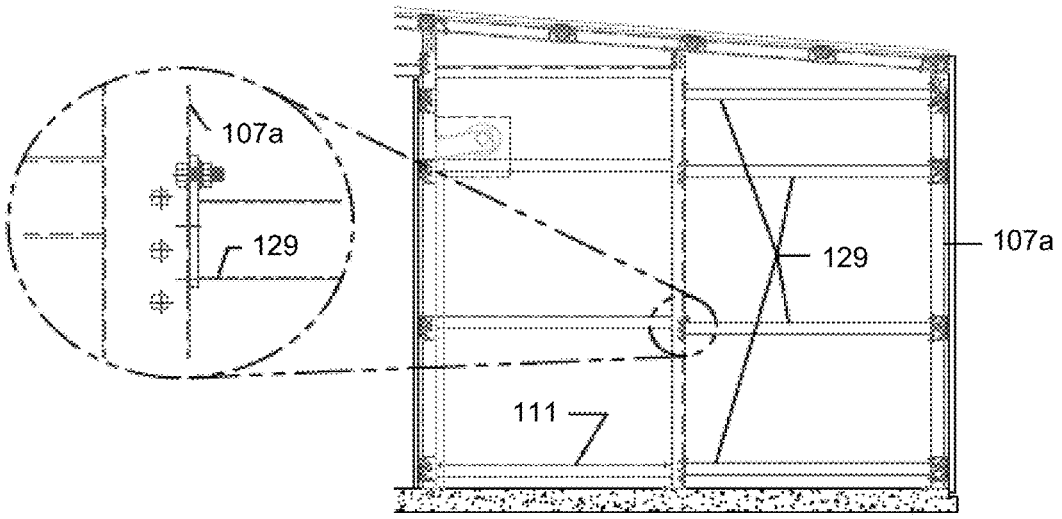
FIG. 18 is a side view of a spacer used in the modular structure system of FIG. 1.

Referring now also to FIG. 18 in the drawings, a spacer 129 used in system 101 is illustrated. Spacer 129 is similar in form and function to that of beams 117*a-c* except that spacer 129 is configured to extend from frame 111 and another column or post 107. Spacer 129 may include mating studs for engaging corresponding mating apertures on frame 111 and posts/columns. Ideally, spacer 129 is located as close to a beam or other horizontal brace member as possible.

Figure 19:
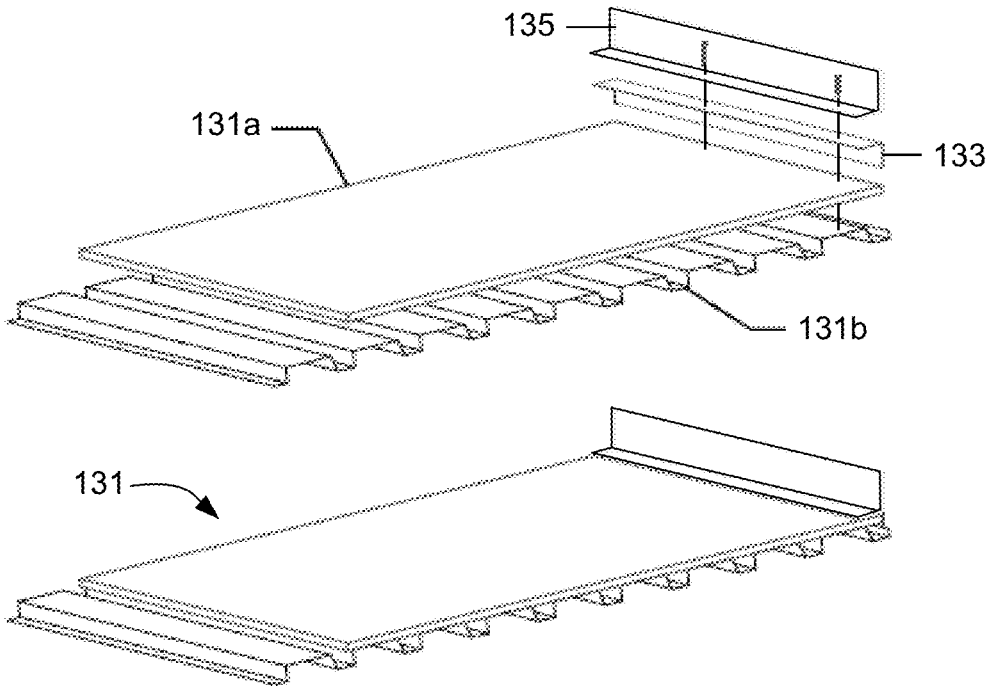
FIG. 19 is a deck for use in the modular structure system of FIG. 1.
Figure 20:
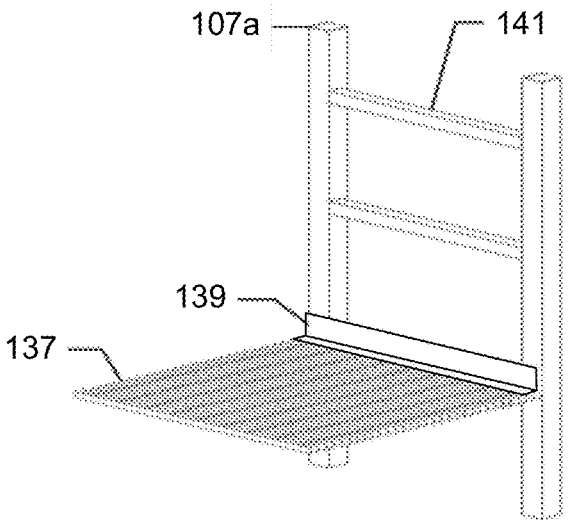
FIG. 20 is a perspective view of a handrail and floor member in the modular structure system of FIG. 1.

Referring now also to FIGS. 19 and 20 in the drawings, perspective views of optional members of system 101 are illustrated. In FIG. 19 a deck 131 is shown. Deck 131 may include a facia 133 and a kick plate 135. Deck 131 is configured to provide a suitable floor for walking or storage. Deck 131 may be used on any floor within system 101 and can be made from a composite material 131*a* (resin-deck) layered with a B-Deck 131*b* for saving on total weight of the system compared to concrete. Other materials and combinations are contemplated.

Another type of exemplary flooring member is shown in FIG. 20. Here a grate 137 is used to replace deck 131. It is generally used if there a sprinkler system as if fails to prevent the spread of fires as good as deck 131. An advantage of grate 137 is it allows better air conditioning to the hallways. A kick plate 139 may also be included. Additionally, a handrail 141 is also shown spanning the distance between the posts. These are useful to assist in providing a stabilizing grip for a user as well as a barrier. The height and location of attachment may be anywhere there is a mating aperture on the posts.

Figure 21:
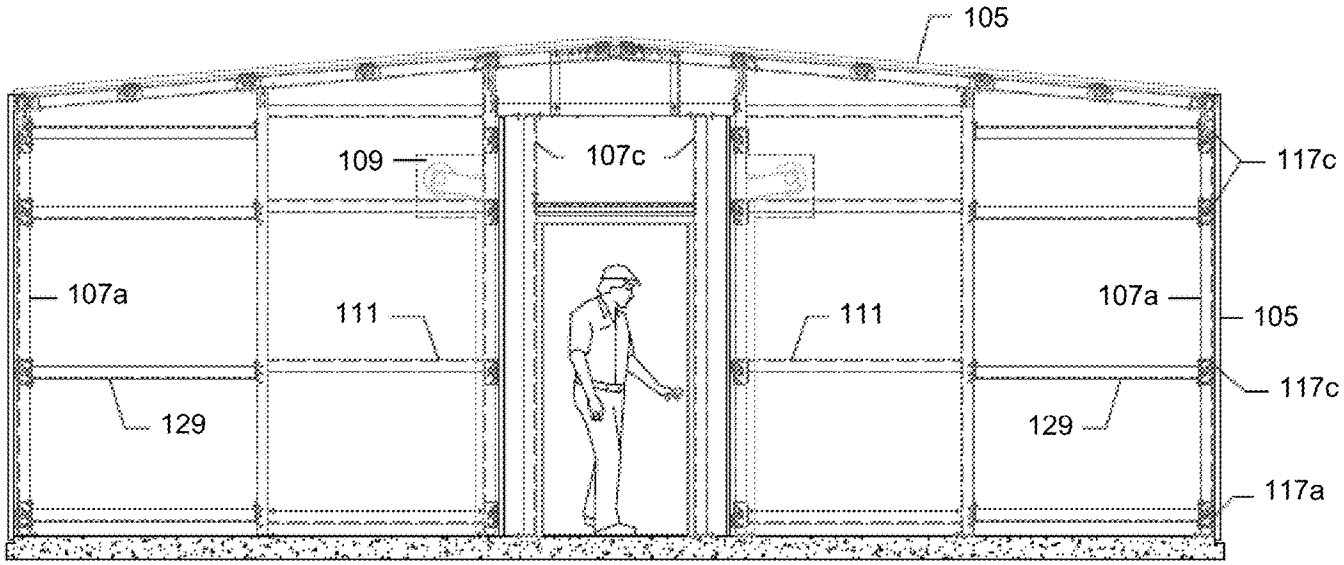
FIG. 21 is a section view of the modular structure system of FIG. 1.

Referring now also to FIG. 21 in the drawings, a cross section view of the structure shown in FIG. 1 is illustrated. In FIG. 21, an exemplary layout showing the posts and beams working together to form the structure of system 101 is seen.

Figure 22:
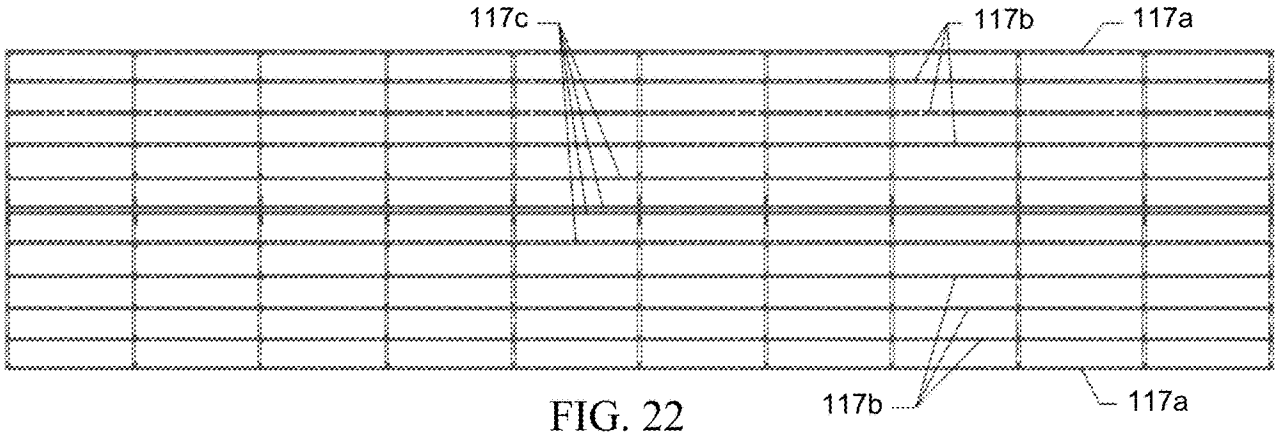
FIG. 22 is a top view of the modular structure system of FIG. 1.

Referring now also to FIG. 22 in the drawings, a top view of the structure shown in FIG. 1 is illustrated. The roof is shown without siding or other roofing material to show the various cross members in play. Posts, beams, trusses, and the sort (i.e. cross members) may be attached to the tops of posts to form the roof structure. Angled brackets using mating apertures similar to those discussed above may be used to create a secure fitting. The bracket may include a predefined angled portion for locating at least one of a mating aperture or mating stud to secure the cross member.

The current application has many advantages over the prior art including at least the following: (1) a system for the construction of a structure wherein the system is modular; (2) the system is fully adjustable in its layout by modifying the location of one or more beams after assembly; (3) reduced overall weight of the structure; and (4) reduced overall cost for completing the structure.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A modular structure system, comprising: a plurality of posts vertically oriented to define a space, each of the plurality of posts including a mating aperture and at least one anchor plate coupled to an end of each of the plurality of posts, the anchor plate covering the end each of the posts and extending outward beyond each of the posts so as to increase the footprint of each of the plurality of posts; a beam coupled to the plurality of posts, the beam configured to divide space, the beam also including an end clip coupled to an end of the beam creating an off-set of the beam relative to the plurality of posts such that when coupled the beam is located partially outside a face of the plurality of posts, the end clip only partially covering the end of the beam, the beam including a mating stud protruding out from the end clip and configured to pass through the mating apertures of the plurality of posts, the end clip configured to support the mating stud; an anchor in communication with each of the plurality of posts to secure each of the posts into a desired position, the anchor passing through the anchor plate; and a siding member configured to couple to the plurality of posts and the beam to restrict access between the plurality of posts; wherein the location of the beam is interchangeable between the plurality of posts so as to adjust the layout of the space.

2. The system of claim 1, further comprising:

a prebuilt frame including a set of vertical posts and a horizontal beam.

3. The system of claim 2, wherein the length of the plurality of posts in the frame is unequal.

4. The system of claim 1, wherein the end clip includes a fastening aperture.

5. The system of claim 1, wherein the end clip is off-set relative to the beam.

6. The system of claim 1, wherein the end clip is centered relative to the beam.

7. The system of claim 1, wherein at least one of the plurality of posts and the beam are shaped in a rolled formed C section.

8. The system of claim 1, wherein at least one of the plurality of posts and the beam are shaped in a formed C section.

9. The system of claim 1, wherein at least one of the plurality of posts and the beam are shaped having a structural channel.

10. The system of claim 1, wherein at least one of the plurality of posts and the beam are shaped in a tube section.

11. The system of claim 1, further comprising:

a floor member releasably coupled to at least one of the plurality of posts and the beam, the floor member having a mating stud for coupling to the mating aperture.

12. The system of claim 1, further comprising:

a spacer configured to separate adjacent posts within the plurality of posts, the spacer configured to include a mating stud for acceptance into the mating aperture.

13. A method of constructing a modular structure, comprising: locating a plurality of posts in a vertical orientation on a foundation, each of the plurality of posts including at least one anchor plate coupled to an end of each of the posts, the anchor plate covering the end of each of the posts and extending outward beyond each of the posts so as to increase the footprint of each of the posts; anchoring the posts in position; locating one or more beams between the plurality of posts; and coupling an end clip to an end of one of the one or more beams to create an off-set of the beam relative to the plurality of posts such that when coupled the beam is located partially outside a face of the plurality of posts, the end clip being coupled to the one or more beams, the end clip including a mating stud for passage into a mating aperture of the one or more posts, the end clip only partially covering the end of the one or more beams; wherein the one or more beams are adjustable to vary the defined space between the one or more posts.

14. The method of claim 13, further comprising:

forming the mating aperture in one of the plurality of posts.

15. The method of claim 13, further comprising:

inserting a fastener through the end clip.

16. The method of claim 13, further comprising:

trimming at least one or the beam and the plurality of posts.

* * * * *